US005888063A

United States Patent [19]

Scott et al.

[11] Patent Number: 5,888,063

[45] Date of Patent: Mar. 30, 1999

[54] METHOD AND APPARATUS FOR QUICK PURGING A MULTIPLE BED REGENERATIVE FUME INCINERATOR

[76] Inventors: Gregory J. Scott, 4 Falcon Ct., Wilmington, Del. 19808; Reagan Houston, 252 Foxhunt La., Henersonville, N.C. 28791

[21] Appl. No.: 612,087

[22] Filed: Mar. 7, 1996

[51] Int. Cl.[6] ..... F27D 17/00

[52] U.S. Cl. ..... 432/181; 432/180; 432/20; 432/28; 432/72; 432/175; 110/210; 110/211; 137/240; 137/309; 422/173; 422/175; 422/179; 422/178; 423/245.3

[58] Field of Search ..... 110/210, 211; 432/20, 28, 72, 179, 180, 181, 245.3; 137/240, 309; 422/173, 175, 178

[56] References Cited

U.S. PATENT DOCUMENTS

| | | | |
|---|---|---|---|
| 1,739,973 | 10/1929 | Mambourg . | |
| 1,933,571 | 11/1933 | Trinks . | |
| 1,943,957 | 1/1934 | Godard . | |
| 2,157,553 | 5/1939 | McDonnell . | |
| 3,045,692 | 7/1962 | Reynolds et al. | 137/240 |
| 3,207,493 | 9/1965 | Swain . | |
| 3,870,474 | 3/1975 | Houston | 432/181 |
| 5,134,945 | 8/1992 | Reimlinger et al. | 137/309 |
| 5,145,363 | 9/1992 | Nielsen et al. | 432/180 |
| 5,184,951 | 2/1993 | Nutcher et al. | 432/181 |
| 5,240,403 | 8/1993 | McAnespie | 432/181 |
| 5,286,459 | 2/1994 | Krismanth | 422/173 |
| 5,293,827 | 3/1994 | Nester et al. | 137/309 |
| 5,346,393 | 9/1994 | D'Souza | 432/179 |
| 5,364,259 | 11/1994 | Matros et al. | 422/178 |
| 5,375,622 | 12/1994 | Houston | 137/240 |
| 5,417,927 | 5/1995 | Houston | 432/181 |
| 5,453,259 | 9/1995 | D'Souza | 423/245.3 |

*Primary Examiner*—Henry A. Bennett
*Assistant Examiner*—Georgy Wilson

[57] ABSTRACT

A method of quick purging beds of a regenerative fume incinerator which is practically applicable for use in 2, 3 and 4 bed incinerators. For a very short purge period near the end of an operating time cycle, the bed being switched from receiving impure gases to discharge of clean gas is purged of impure gases by being supplied with clean gas discharged by the incinerator. The quick purging takes less than 4% of the cycle time and thus inflow of impure gases is stopped for a very brief period when this quick purge method is used in a 2 bed incinerator. When using this quick purge method in a three or four bed regenerative fume incinerator there is always at least one bed receiving impure gases. This quick purge method improves the quality of the discharged clean gas without significant loss of thermal efficiency and without significant reduction in operating capacity.

18 Claims, 6 Drawing Sheets

METHOD AND APPARATUS FOR QUICK PURGING A MULTIPLE BED REGENERATIVE FUME INCINERATOR

TECHNICAL FIELD

This invention relates to quick purging of multiple bed regenerative fume incinerators to avoid discharge of impure gases and which minimizes thermal loss and maximizes the purification capacity of the incinerator.

BACKGROUND OF THE INVENTION

The usual two bed regenerative fume incinerator, or regenerative thermal oxidizer, has two ceramic filled beds, a combustion zone operating at about 1600 degrees F. and valving at the cold ends of the beds to switch the gas flow direction through the beds every minute or so. Unfortunately, when the beds are switched, the bed which was receiving impure gas containing oxygen and volatile organic compounds, suddenly becomes the exit bed and a surge of impure air leaves the incinerator.

Several expensive methods of handling the surge of impurities, which occurs upon switching flow through the ceramic beds, have heretofore been proposed. U.S. Pat. No. 3,3870,474 teaches the use of a third bed so that a bed can be purged clean before it is put back in operation, and also teaches the use of an empty vessel to receive the surge and slowly feed the surge gases back to a receiving bed. Both of these teachings require the use of a bed or vessel about the size of the regenerative beds. The system shown in U.S. Pat. No. 5,184,951, purges the dirty bed while bypassing the impure feed directly to the combustion chamber. The bypassing results in a large thermal loss. U.S. Pat. No. 5,145,363 teaches discharge from the combustion chamber to the exhaust stack while the dirty bed is purged. This also results in a large thermal loss.

OBJECTS AND SUMMARY OF THE INVENTION

It is a primary object of this invention to provide a method of purging a dirty bed of a regenerative fume incinerator without a significant thermal loss. It is a further object of this invention to provide a method of purging a dirty bed which minimizes the length of time the purged bed is kept from its normally assigned function.

In a multiple bed regenerative fume incinerator the beds may be switched every 10 to 600 seconds, with 30 to 120 seconds being more common and preferred. I have found that a purging of a dirty bed only requires about ⅓ to 4 seconds. I have also determined that in many situations stopping the feed flow of impure gas to the incinerator for 0.5 to 4% of the time does not cause any significant problem in operation of the incinerator. In the method of this invention, at the time the beds are switched the flow of impure gas is stopped and clean gas is feed to the bed which was the receiving bed for impure gas. Since a blower is used in incinerators to force discharge of cleaned gases, I prefer to direct cleaned gas by way of a purge conduit interconnecting the blower discharge and a point in the feed line between the feed line shut off valve and the valve, or valves, used for switching the flow through the beds. A shut off valve is placed in the purge conduit. With such equipment and an automatic control for operating the valves at predetermined times, the shut off valve for the feed flow is closed and the shut off valve for the purge conduit is opened for a purge period of 0.5 to 4 seconds. At the end of the purge period, the shut off valve for the feed line is opened, the bed switching valve, or valves, is operated to switch beds and the shut off valve for the purge conduit is closed. Alternatively, a single directional valve may be used in place of the two shut off valves. In some fume incinerators it may not be necessary to use a shut off valve in the feed line because the pressure of discharged clean gas may be sufficient to prevent incoming flow of impure gas. The method of this invention may be used in operating other multiple bed regenerative fume incinerators, such as those having 3 and 4 beds. This invention may also be used in operating a multiple bed incinerator system which uses a feed gas delivery blower rather than an exhaust blower for the cleaned gases.

BRIEF DESCRIPTION OF THE DRAWINGS

Several incinerator systems in which the method of this invention can be used are illustrated in the drawings, in which.

DETAILED DESCRIPTION OF THE DRAWINGS

Figure 1:
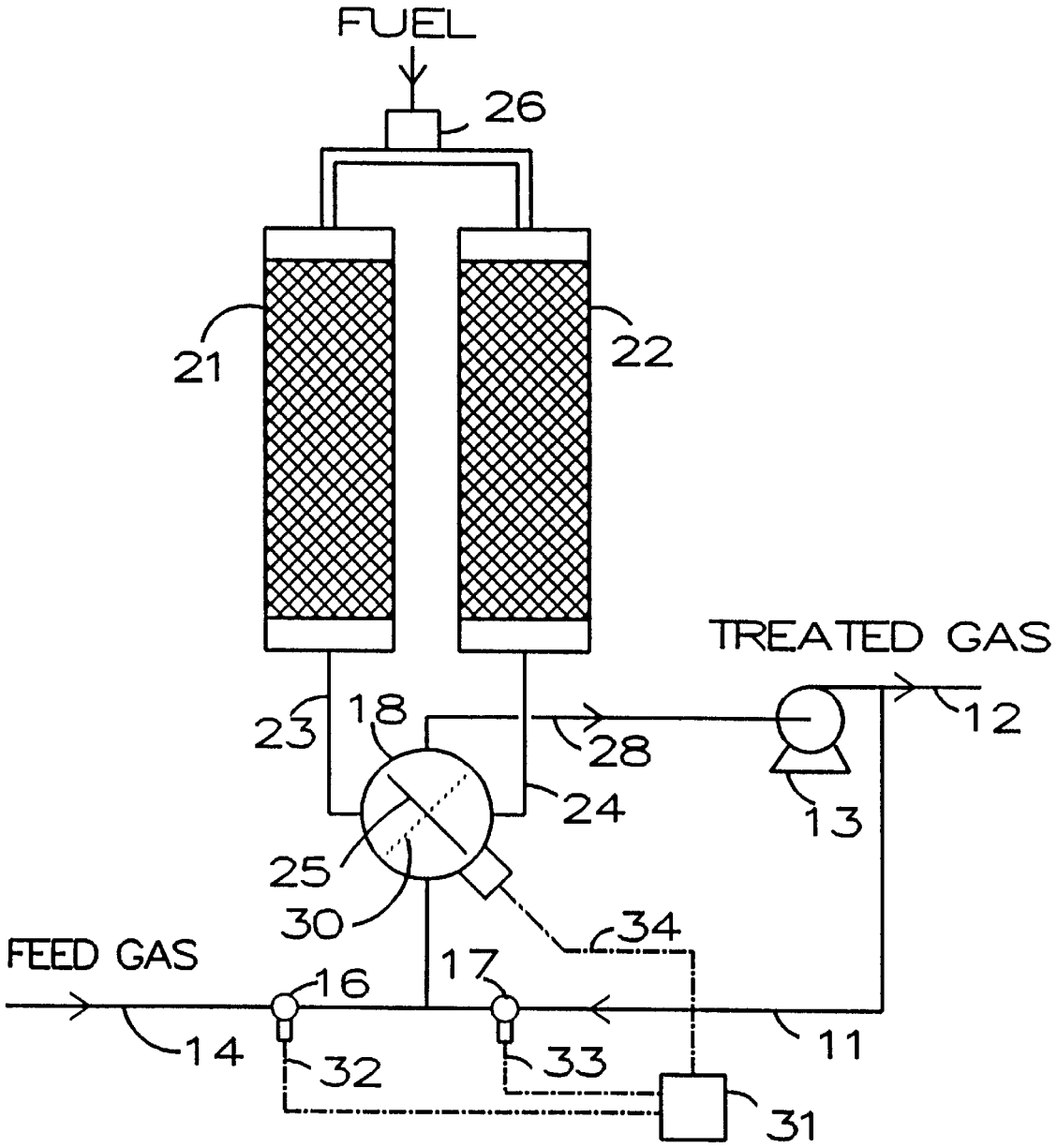
FIG. 1 is a schematic illustration of a 2 bed regenerative incinerator with automatic control system.

In the 2 bed regenerative incinerator system shown in FIG. 1, a purge conduit 11 is connected at one of its ends to the clean air exhaust conduit 12 of the exhaust blower 13 and is connected at its other end to the impure gas input conduit 14. An electrically operated impure gas shut off valve 16 is installed in the impure gas input conduit 14 upstream of the junction of the impure gas input conduit 14 and the purge conduit 11. An electrically operated purge gas shut off valve 17 is installed in the purge conduit 11. The impure gas input conduit 14 is connected to an electrically operated switching valve 18 which in turn is connected to ceramic beds 21, 22 by connector conduits 23, 24. The switching valve includes a flow control element in the form of a vane 25 which in its solid line position shown in FIG. 1, directs impure gas flow to the bed 21 and directs clean gas flow from the bed 22 to the exhaust blower 13. The vane 25 is rotatable to a second position of adjustment shown by broken line 30 in which impure gases are delivered to the bed 22 and clean gases from bed 21 are discharged by way of an exhaust conduit 28 and the blower 13. The tops of the incinerator beds 21, 22 are connected to a combustion chamber 26 to which fuel may be supplied for start up and also during operation if there is insufficient combustible matter in the impure gas to maintain the desired temperature necessary to oxidize the impurities.

An automatic electronic control 31 is provided to carry out the steps of the inventive method. The control 31 is connected by lines 32, 33, 34 to the electrically driven actuators incorporated in the valves 16, 17. 18. The control 31 operates the switching valve 18 at predetermined intervals or cycles, such as 30 to 120 second periods of time, to switch the beds between receiving and discharging functions. Near the end of each cycle, such as one half to four seconds prior to operating the switching valve 18, the automatic control closes the impure gas shut off valve 16 and opens the purge gas shut off valve 17. This causes clean gas to flow through the switching valve 18, the bed which had just previously been receiving impure gases and the conduit by which it is connected to the switching valve 18. As a consequence of this quick purge, the contaminated bed, the switching valve and the conduit connecting the switching valve to the purged bed are purged of impurities. Without purging, the impure gases in the contaminated bed, in the switching valve 18 and in the conduit connecting the contaminated bed to the switching valve would have been exhausted, thus contaminating the cleaned gas being discharged. The purge flow forces the impure gases remaining in the bed to the combustion chamber 26 where the impurities are oxidized. At the end of the quick purge segment of the cycle, the automatic control 31 operates the switching valve 18 to connect the purged bed with the exhaust blower 13 and the impure air conduit 14 with the other bed and at the same time the automatic control 31 closes the purge gas shut off valve 17 and opens the impure gas shut off valve 16. Thus the inflow of impure gases is stopped for a small period of time while the purging takes place, thus maximizing the productive operating time of the incinerator. The purging operation has minimal effect on thermal efficiency. The heat remaining in the clean exhaust gas used for purging is transferred to the purged bed and the heat added to the purge flow as it is combusted in the combustion chamber is transferred to the other bed.

If the pressure of the impure gas in the input conduit 14 is sufficiently lower than the pressure of the purge gas in purge conduit 11, it may be practical to eliminate the impure gas shut off valve 16, because the higher pressure purge gas will prevent inflow of impure gas during purging.

For added convenience an electrically operated variable quantity delivery valve or an electrically operated variable quantity delivery fuel pump may be used to deliver fuel to the combustion chamber together with a suitable electrically operated ignitor; and these components may be connected to and operated by the automatic control 31. The blower 13 may also be driven by a variable speed electric motor connected in controlled relation to the automatic control.

Figure 2:
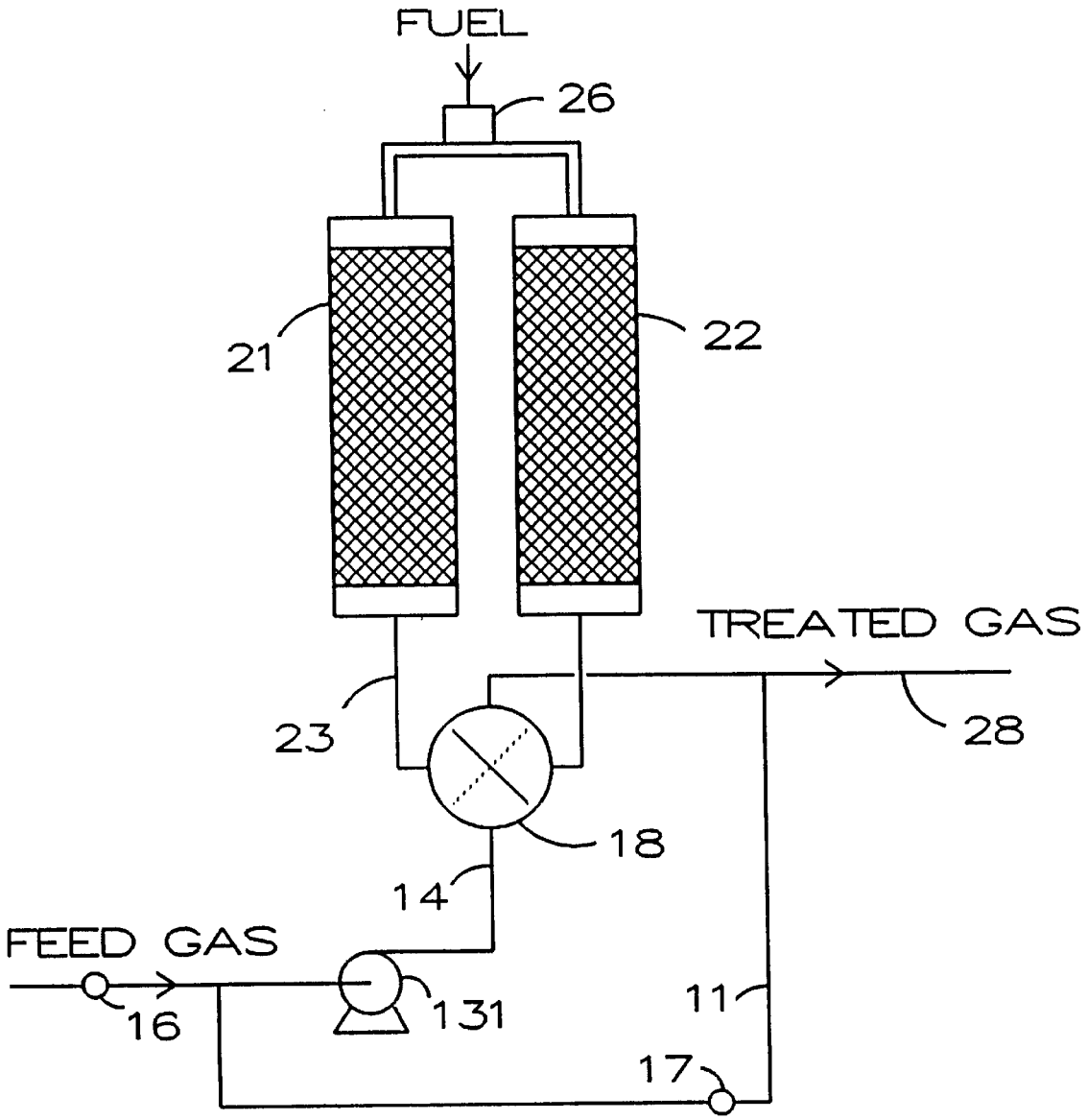
FIG. 2 is a schematic drawing showing a 2 bed regenerative incinerator system With an impure gas delivery blower.

The method of this invention can also be used to operate a multiple bed regenerative fume incinerator which uses a blower to deliver impure gas to the incinerator switching valve, such as shown in FIG. 2. In such an installation, the exhaust blower may be omitted. As shown in FIG. 2, an impure gas delivery blower 131 is installed in the impure gas input conduit 14 upstream of the connection of one end of the purge conduit 11 with the impure gas input conduit 14. As shown in FIG. 2, the other end of the purge conduit is connected to the exhaust conduit 28. The electronic automatic control 31 is connected to the valves 16, 17 and 18 for controlling them in the same manner as described for control of the incinerator illustrated in FIG. 1.

Figure 3:
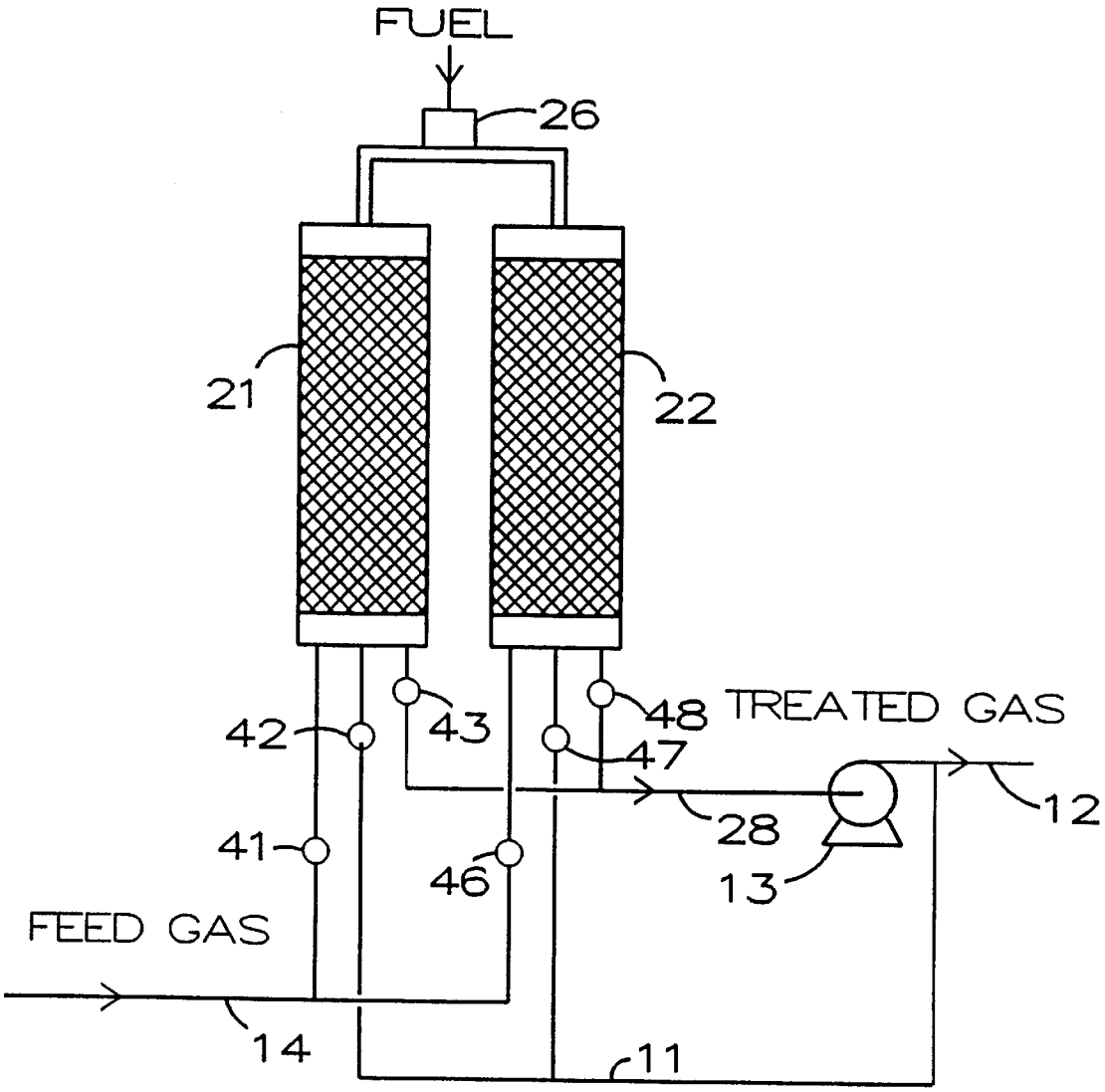
FIG. 3 is a schematic showing of a 2 bed regenerative incinerator system using six shut off valves to control the switching and purging functions.

FIG. 3 shows a 2 bed regenerative fume incinerator in which 6 shutoff valves are used to control switching and purging functions of the method for operation of the incinerator of this invention. Shut off valves 41 and 46 are alternately switched between open and close positions of adjustment to deliver impure gas to the beds 21, 22 and shut off valves 43 and 48 are alternately switched between open and close positions to exhaust clean gas via exhaust conduit 28. Purge gas shut off valves 42 and 47 are alternately open and close positions to deliver purge gas to the beds 21 and 22. A few seconds before the end of an operating cycle time period of some 30 to 120 seconds, in which the bed 21 is receiving impure gas, the shut off valve 41 will be moved by the automatic control to a close position and the purge gas shut off valve 42 will be adjusted from a close position to an open position. At the end of the cycle time period, the purge shut off valve 42 is closed, the exhaust shut off valve 43 is opened, the impure gas shut off valve 46 is opened and the exhaust shut off valve 48 is closed, thus starting a new cycle in which the functions of the beds are reversed. Near the end of the new cycle the bed 22 will be automatically purged through the opening and closing of the appropriate shut off valves by the automatic control 31.

Figure 4:
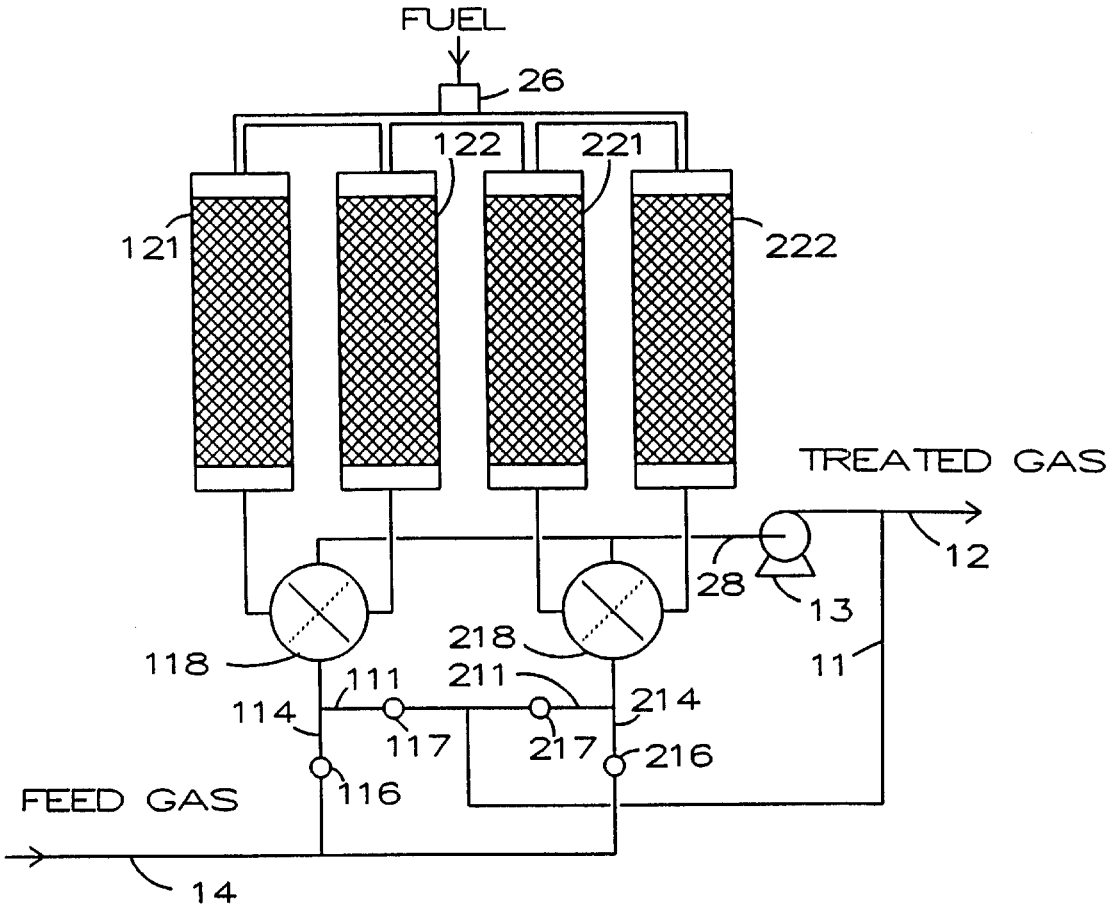
FIG. 4 is a schematic illustration of a 4 bed regenerative incinerator with a single combustion chamber which uses 2 switching valves for controlling the bed switching functions and 4 shut off valves for controlling the purging operations.

FIG. 4 shows a 4 bed regenerative fume incinerator having two switching valves 118, 218 with switching valve 118 controlling flow to and from beds 121 and 122 and with switching valve 218 controlling flow to and from beds 221 and 222. Impure gas shut off valves 116 and 216 control flow of impure gas via impure gas branch conduits 114 and 214 to the switching valves 118, 218 and purge gas shut off valves 117, 217 control the flow of purge gas via purge gas branch conduits 111, 211 to the impure gas input line branches 114, 214. By using two switching valves, the cycling periods for the two sets of beds can be staggered; for instance, the cycle period for one pair of beds can end midway through the cycle period for the other pair of beds. In this method there is inflow of impure air at all times. The quick purge method of this invention can also be used in operating a 6 bed regenerative fume incinerator in which a single combustion chamber is shared by all the beds and 3 switching valves control the directional flow through the three pairs of beds. That is, the three switching valves control the flow of impure gas to and the clean gas from three different pairs of beds. The timing of the operating cycles for the three pairs of beds is staggered so that only one bed is purged at a time, thus providing the least disruption of inflow of impure gases to the incinerator. There is no overlap in the purging intervals of the three pairs of beds.

Figure 5:
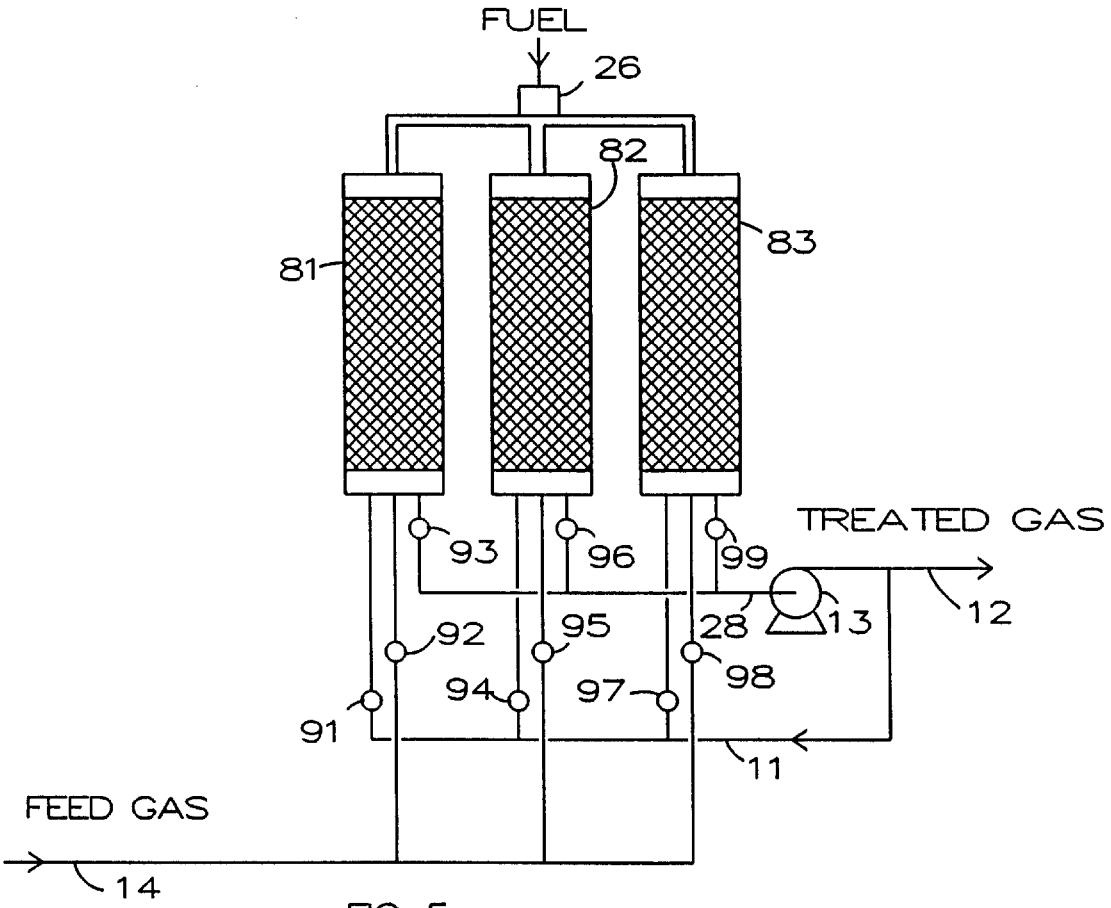
FIG. 5 is a schematic illustration of a 3 bed regenerative incinerator system using 9 shut off valves for controlling the switching and purging functions and FIG. 6 is a schematic illustration of a 2 bed regenerative incinerator system which uses a directional valve for controlling flow of impure gas and purge gas to the switching valve.

The incinerator of FIG. 5 has 3 beds 81, 82, 83 and nine shutoff valves 91, 92, 93, 94, 95, 96, 97, 98, 99 for controlling switching and purging functions. There are two methods for operating the 3 bed regenerative fume incinerator shown in FIG. 5. In a first method 2 beds receive impure gas and one bed exhausts clean gas. Table 1 below shows the sequencing operation of the beds and the flow of gas therethrough using this first method:

TABLE 1

| Time in | | Beds | | | Valves | | | | | | | | |
|---|---|---|---|---|---|---|---|---|---|---|---|---|---|
| Seconds | Step | 81 | 82 | 83 | 91 | 92 | 93 | 94 | 95 | 96 | 97 | 98 | 99 |
| 60 | 1 | in | out | out | C | O | C | C | C | O | C | C | O |
| 2 | 2 | purge | in | out | O | C | C | C | O | C | C | C | O |
| 60 | 3 | out | in | out | C | C | O | C | O | C | C | C | O |
| 2 | 4 | out | purge | in | C | C | O | O | C | C | C | O | C |
| 60 | 5 | out | out | in | C | C | O | C | C | O | C | O | C |
| 2 | 6 | in | out | purge | C | O | O | C | C | O | O | C | C |

C = closed
O = open

The automatic control operates the valves 91–99 to sequentially repeat the steps of Table 1 with step 1 following step 6.

The second method of operating the 3 bed incinerator of FIG. 5 is shown in the following Table 2:

TABLE 2

| Time in | | Beds | | | Valves | | | | | | | | |
|---|---|---|---|---|---|---|---|---|---|---|---|---|---|
| Seconds | Step | 81 | 82 | 83 | 91 | 92 | 93 | 94 | 95 | 96 | 97 | 98 | 99 |
| 60 | 1 | in | in | out | C | O | C | C | O | C | C | C | O |
| 2 | 2 | in | purge | out | C | O | C | O | C | C | C | C | O |
| 60 | 3 | in | out | in | C | O | C | C | C | O | C | O | C |
| 2 | 4 | purge | out | in | O | C | C | C | C | O | C | O | C |
| 60 | 5 | out | in | in | C | C | O | C | O | C | C | O | C |
| 2 | 6 | out | in | purge | C | C | O | C | O | C | O | C | C |

C = closed
O = open

Following step 6, the sequence of steps is repeated over and over by the automatic control operating the shut off valves 91–99. A marked advantage of employing the method of this invention in operating a 3 bed regenerative fume incinerator, is that there is always input flow of impure gases to at least one bed at all times including purge intervals. While flow through the incinerator is slowed during the brief purge interval, it is not stopped and the somewhat disruptive effect of completely stopping the inflow of impure gas is avoided.

Figure 6:
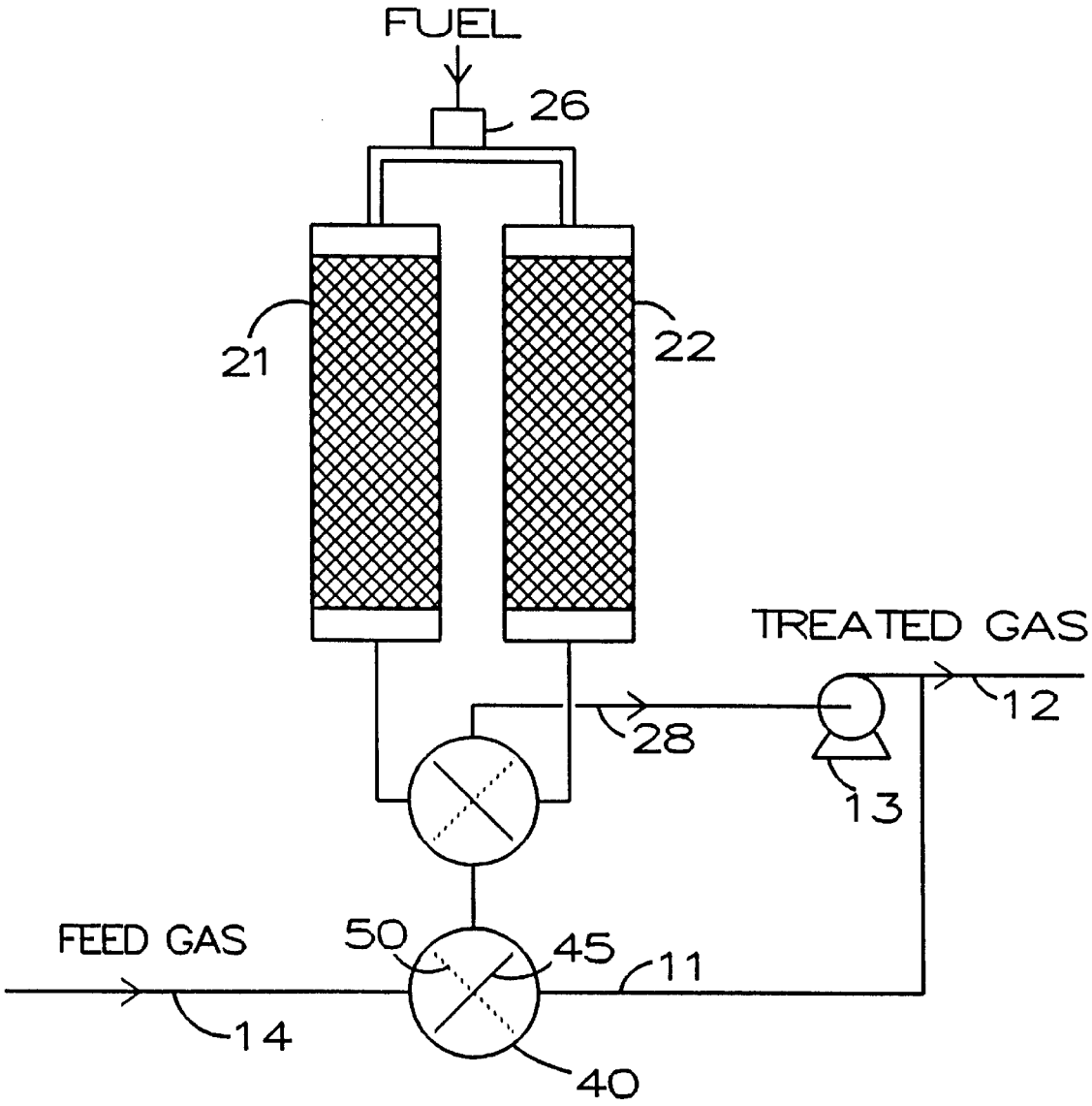

FIG. 6 illustrates a 2 bed regenerative fume incinerator similar to that shown in FIG. 1, but incorporating a single directional valve 40 in place of the shutoff valves 16, 17 used in the FIG. 1 incinerator. When the quick purge period of time is reached near the end of a cycle of incinerator operation, the flow control element in the form of a vane 45 is rotated from its illustrated solid line position, in which impure gases are delivered to the switching valve, to an adjusted position shown by a broken line 50, in which the inflow of impure gases is blocked and clean gases are delivered to the switching valve 18 by way of the purge conduit 11 interconnecting the directional valve 40 and the exhaust 12 of the exhaust blower 13. The switching of the beds 21,22 and the quick purging during the final few seconds of the operating cycle is carried out in an automated fashion in the same manner as described for the system shown in FIG. 1, but with the automatic control adjusting the directional valve 40 between its two position of adjustment instead of opening and closing the shut off valves 16,17.

OPERATING SUMMARY

When operating the 2 bed regenerative fume incinerators of FIGS. 1, 2, 3 and 6 using the method of this invention, two cycles are repeated over and over once the incinerator has been placed in operation. In the first cycle impure gases are delivered to a first bed of the incinerator and clean gas is exhausted from the second bed. The last few seconds, such as 0.5 to to 4 seconds, of the first cycle are used to purge the switching valve, the first bed and the branch conduit by which the first bed is connected to the switching valve. This is accomplished by stopping the inflow of impure gases to the switching valve and by delivering clean gas to the switching valve from the exhaust flow from the incinerator. At the end of the brief purge segment of the first cycle, the switching valve is adjusted to deliver impure air to the second bed, the flow of impure air to the switching valve is restored and the flow of clean air from the exhaust to the switching valve is stopped. This quick purge period or segment of the first cycle forces the contaminated gases in the switching valve, the first bed and the interconnecting branch conduit to the combustion chamber where the impurities are oxidized and rendered harmless. In the second cycle of operation of the incinerator, the switching valve is positioned as described for the termination of the first cycle. During the last few seconds of the second cycle the flow of impure gas to the switching valve is stopped and replaced by delivery of clean gas from the incinerator discharge. The contaminating gases are purged from the second bed, the switching valve and the interconnecting branch conduit and purified in the combustion chamber during the brief purge segment of the second cycle. The second cycle is concluded by adjusting the switching valve to a position in which the second bed is connected to exhaust and the first bed is connected to inflowing impure gases and by stopping delivery of clean gas from the discharge to the switching valve.

An alternate but less preferred method of operating incinerators is to reverse the flow direction of the purging gas. In the previously described method, when a bed containing impure gas is purged, the purge gas forces impure gas directly into the combustion chamber. An alternate but less desirable method is to flow the purge gas from the combustion chamber to the impure bed to the valve mechanism through the blower to the valve mechanism again to the clean bed and then into the combustion chamber for purification. This purge method takes longer even up to 6% of the cycle.

In operating the 4 bed regenerative fume incinerator shown in FIG. 4, the cyclic operation of each pair of beds is the same as described for a 2 bed incinerator, The cycles are of equal time periods, however, the timing of the cycles of one pair of beds is staggered in relation to the timing of the cycles of the other pair of beds. This prevents the purge segments from coinciding and insures that impure gases flow at all times to at least one of the pairs of beds.

The cycling of a 3 bed regenerative fume incinerator using the quick purge method of this invention is different from that described herein for the other multiple bed incinerators, if during normal operation it is operated in the mode wherein two beds are connected to discharge and only one bed is connected to inflow of impure gases. As shown in Table 1, inflow of impure gases is continued during each brief purge period by switching flow in one of the discharge beds at the beginning of the purge period. Since a discharging bed is free of contamination, the switching of one of the two discharging beds at the beginning of purging does not give rise to any contamination problems. When operating a 3 bed incinerator with two beds receiving impure gases and one bed discharging clean gas, one of the two impure gas receiving beds is purged during the brief purge period by stopping inflow of impure gases to the one bed and supplying it with clean exhaust gas. At the end of the purge period the purged bed is switched to discharge clean gas and bed previously discharging clean gas is switched to receive impure gas.

What is claimed is:

1. A method of quick purging a regenerative fume incinerator which is operable to purify impure gas and which has first and second beds, a combustion chamber which is connected to the hot ends of said beds, a clean gas discharge, a valve mechanism for selectively directing impure gas to a selected one of said beds, then through said combustion chamber and directing clean gas from said combustion chamber through the other of said beds to said clean gas discharge, a blower for inducing gas flow through said incinerator and discharge of clean gas through said clean gas discharge and a control system for operating said valve mechanism to cyclically switch said beds between impure gas receiving status and clean gas discharge status, said method comprising the steps of:

placing said incinerator in operation, in which condition the valve mechanism is adjusted to direct impure gas to said first bed and to direct clean gas from said second bed to said clean gas discharge, operating said incinerator through a major portion of a first time cycle as adjusted in the previous step, stopping the inflow of impure gas to said valve mechanism during the remaining portion of said first time cycle, said remaining portion being a purge period less than 4% of said first time cycle and simultaneously delivering clean gas from said clean gas discharge to said valve mechanism whereby said clean gas forces impure gas from said first bed and into said combustion chamber, simultaneously restoring inflow of impure gases to said valve mechanism, stopping flow of clean gas from said clean gas discharge to said valve mechanism and operating said valve mechanism to direct impure gas to said second bed and discharging clean gas from said first bed to said clean gas discharge, operating said incinerator through a major portion of a second time cycle as adjusted in the immediately previous step, stopping the inflow of impure gas to said valve mechanism during the remaining portion of said second time cycle, said remaining portion being a purge period less than 4% of said second time cycle and simultaneously delivering clean gas from said clean gas discharge to said valve mechanism whereby impure gas in said second bed is forced to said combustion chamber for purification and restoring the flow of impure gas to said valve mechanism and simultaneously stopping the flow of said clean gas from said clean gas discharge to said valve mechanism and operating said valve mechanism to direct impure gas to said first bed and to deliver clean gas from said second bed to said clean gas discharge.

2. The method of claim 1 wherein said first and second cycles are substantially between 10 and 600 seconds in length.

3. The method of claim 2 wherein said purge period is ½ to 4 seconds in length.

4. The method of claim 1 wherein said first and second cycles are each 30 to 120 seconds in length and said purge periods are each 1 to 2 seconds.

5. The method of claim 1 wherein said blower is an exhaust blower and wherein said clean gas discharged by said blower is directed to said valve mechanism during said purge periods.

6. The method of claim 1 wherein said blower delivers impure gas to said valve mechanism and wherein said clean gas from said clean gas discharge is fed to the input side of said blower during said purge periods.

7. The method of claim 1 wherein said valve mechanism includes a switching valve operable to control the flow of impure gas to and clean gas from said beds whereby flow through the beds may be selectively reversed and wherein shut off valves are employed to control the flow of impure gas and clean gas from said clean gas discharge to said valve mechanism.

8. The method of claim 1 wherein said blower is an exhaust blower for discharging clean gas and wherein clean gas discharged by said blower is delivered to said valve mechanism during said purge periods at a pressure greater than the pressure of said impure gas received by said incinerator whereby the inflow of impure gas to said valve mechanism is stopped during said purge periods.

9. The method of claim 1 wherein said incinerator includes third and fourth beds connected to said combustion chamber and to said valve mechanism, said third and fourth beds operating in the manner of said first and second beds except the timing of the cycles of said third and fourth beds are staggered in time relationship with the cycles of said first and second beds whereby only one bed will be purged at any given time.

10. A method of quick purging a regenerative fume incinerator operable to purify impure gas and of the type having first, second and third ceramic beds, a single combustion chamber connected to the hot ends of the three beds, valve mechanism for controlling flow of impure gas to one of said beds and clean gas from the other of said beds by way of a clean gas discharge and control mechanism for controlling said valve mechanism, said method comprising the steps of:

operating said incinerator through a first time cycle with said first bed connected to a supply of impure gas and said second and third beds connected to said clean gas discharge, conducting a quick purge of said first bed for a purge period of less than 4% of said first time cycle by stopping flow of impure gas to said first bed and simultaneously connecting said clean gas discharge to said first bed and switching said second bed from discharging clean gas to receiving impure gas, said third bed remaining connected in clean gas delivering relation to said clean gas discharge, stopping the flow of clean gas to said first bed and connecting said first bed in clean gas delivering relation to said clean gas discharge, operating said incinerator as adjusted in the immediately previous step for a second time cycle, conducting a quick purge of said second bed for a purge period of less than 4% of said second time cycle by stopping flow of impure gas to said second bed and simultaneously connecting said clean gas discharge to said second bed and switching said third bed from discharging clean gas to receiving impure gas, said first bed remaining connected in clean gas delivering relation to said clean gas discharge, stopping the flow of clean gas to said second bed and connecting said second bed in clean gas delivering relation to said clean gas discharge, operating said incinerator as adjusted in the immediately previous step for a third time cycle, conducting a quick purge of said third bed for a purge period of less than 4% of said third time cycle by stopping the flow of impure gas to said third bed and simultaneously connecting said clean gas discharge to said third bed and switching said first bed from discharging clean gas to receiving impure gas, said second bed remaining connected in clean gas delivering relation to said clean gas discharge and stopping the flow of clean gas to said third bed and connecting said third bed in clean gas delivery relation to said clean gas discharge.

11. The method of claim 10 wherein said first, second and third time cycles are 10 to 600 seconds in length.

12. The method of claim 10 wherein said purge periods are ⅓ to 4 seconds in length.

13. The method of claim 10 wherein said time cycles are 30 to 120 seconds in length and said purge periods are 1 to 2 seconds in length.

14. A method for quick purging a regenerative fume incinerator of the type having first, second and third ceramic beds connected to a single combustion chamber, a clean gas discharge, valve mechanism for controlling flow of impure gas to two of said beds and clean gas from the other of said beds and a control for operating said valve mechanism to operate said incinerator in a regenerative manner, said method comprising the steps of:

operating said incinerator through a first time interval during which said first and second beds are connected in receiving relation to a source of impure gases and said third bed is connected in clean gas delivering relation to said clean gas discharge, conducting a quick purge of said second bed for a purge period less than 4% of said first time interval by stopping the flow of impure gas to said second bed and connecting said second bed in clean gas receiving relation to said clean gas discharge, stopping the flow of clean gas to said second bed and simultaneously connecting said second bed in clean gas delivery relation to said clean gas discharge and switching said third bed from discharge of clean gas to receipt of impure gas said first bed remaining connected in impure gas receiving relation to said source of impure gas, operating said incinerator for a second time interval as adjusted by the immediately previous step, conducting a quick purge of said first bed for a purge period less than 4% of said second time interval by stopping flow of impure gas to said first bed and delivering clean gas from said clean gas discharge to said first bed, stopping the flow of clean gas to said first bed and simultaneously connecting said first bed in clean gas delivery relation to said clean gas discharge and switching said second bed from discharge of clean gas to receipt of impure gas, said third bed remaining connected in impure gas receiving relation to said source of impure gas, operating said incinerator for a third time interval as adjusted in the immediately previous step, conducting a quick purge of said third bed for a purge period less than 4% of said third time cycle by stopping flow of impure gas to said third bed and simultaneously connecting said third bed in clean gas receiving relation to said clean gas discharge and stopping the flow of clean gas to said third bed and simultaneously connecting said third bed in clean gas delivering relation to said clean gas discharge and switching said first bed from discharge of clean gas to receipt of impure gas said second bed remaining connected in impure gas receiving relation to said source of impure gas.

15. The method of claim 14 wherein said time intervals are 10 to 600 seconds each in length.

16. The method of claim 15 wherein said purge periods are ½ to 4 seconds each.

17. The method of claim 14 wherein said time intervals are 30 to 200 second each in length and said purge periods are each 1 to 2 seconds in length.

18. A method of quick purging a regenerative fume incinerator having at least first and second beds, said incinerator being operable to purify impure gas received from a source of impure gas and being of the type having a combustion chamber which is connected to and shared by said beds, valve mechanism for selectively directing impure gas to one of said beds and clean gas from the other of said beds, a clean gas discharge, a blower for inducing flow through said incinerator and discharge of clean gas through said clean gas discharge and a control system for operating said valve mechanism to cyclically switch said beds between impure gas receiving status and clean gas discharge status, said method comprising the steps of:

placing said incinerator in operation, in which condition the valve mechanism is adjusted to direct impure gas to said first bed and to direct clean gas from said second bed to said clean gas discharge, operating said incinerator through a major portion of a first time cycle as adjusted in the previous step, stopping the inflow of impure gas from said source to said valve mechanism during the remaining portion of said first time cycle, said remaining portion being a purge period less than 6% of said first time cycle, and simultaneously delivering clean gas from said combustion chamber to said first bed, which then flows to said valve mechanism, then to said blower, then to said valve mechanism, then to said second bed and then into said combustion chamber for purification, simultaneously restoring inflow of impure gas from said source to said valve mechanism and operating said valve mechanism to direct impure gas to said second bed and to discharge clean gas from said first bed to said clean gas discharge, operating the incinerator through a major portion of a second time cycle as adjusted in the immediately previous step, stopping the inflow of impure gas from said source to said valve mechanism during the remaining portion of said second time cycle, said remaining portion being a purge period less than 6% of said second time cycle, and simultaneously delivering clean gas from said combustion chamber to said second bed, which then flows to said valve mechanism, then to said blower, then to said valve mechanism, then to said first bed and then to said combustion chamber for purification and simultaneously restoring the flow of impure gas from said source to said valve mechanism and operating said valve mechanism to direct impure gas to said first bed and to deliver clean gas from said second bed to said clean gas discharge.

* * * * *